US007129428B2

(12) United States Patent
Edmunds

(10) Patent No.: US 7,129,428 B2
(45) Date of Patent: Oct. 31, 2006

(54) JOYSTICK CONTROLLER

(75) Inventor: Wayne Edmunds, Gwent (GB)

(73) Assignee: Penny & Giles Controls Limited, Gwent (GB)

( * ) Notice: Subject to any disclaimer, the term of this patent is extended or adjusted under 35 U.S.C. 154(b) by 0 days.

(21) Appl. No.: 11/359,305

(22) Filed: Feb. 21, 2006

(65) Prior Publication Data

US 2006/0191775 A1 Aug. 31, 2006

(30) Foreign Application Priority Data

Feb. 23, 2005 (GB) ..... 0503663.7

(51) Int. Cl.
*H01H 25/04* (2006.01)

(52) U.S. Cl. ..... 200/6 A

(58) Field of Classification Search ..... 200/4, 200/5 R, 6 A, 17 R, 18, 332, 335; 345/156, 345/157, 161

See application file for complete search history.

(56) References Cited

U.S. PATENT DOCUMENTS 3,585,319 A * 6/1971 Payerle et al. ..... 200/6 A
3,818,154 A * 6/1974 Presentey ..... 200/6 A
3,942,148 A * 3/1976 Nishioka ..... 200/6 A
4,849,583 A * 7/1989 Meyer ..... 200/6 A
5,047,596 A * 9/1991 Ebishi ..... 200/4
5,068,498 A * 11/1991 Engel ..... 200/6 A
5,113,179 A * 5/1992 Scott-Jackson et al. ..... 200/6 A
5,151,563 A * 9/1992 Tanaka ..... 200/6 A
5,176,041 A 1/1993 Meier et al. ..... 74/471
5,227,594 A * 7/1993 Russo ..... 200/6 A
5,350,891 A * 9/1994 Ditzig ..... 200/6 A

FOREIGN PATENT DOCUMENTS

GB 2 107 029 A 4/1983
GB 2 155 156 A 9/1985
GB 2 313 175 A 11/1997

* cited by examiner

*Primary Examiner*—Michael A. Friedhofer
(74) *Attorney, Agent, or Firm*—Wells St. John P.S.

(57) ABSTRACT

A joystick controller has a lever mounted for pivotal movement relative to a housing, a seat member affixed to the housing, and a slider member biased towards the seat member. The seat member has a profiled surface that cooperates with a corresponding surface of the slider member. In one aspect, the profiled surface includes at least one lock position for engaging the slider member at a predetermined angle of pivotal displacement of the lever about a first axis. The slider member is shaped to allow pivotal movement of the lever about a second axis, without movement of the slider member, but to prevent movement of the lever about the first axis when engaged in the lock position. In another aspect, the profiled surface has a profile in a first direction whereby the biasing force remains substantially constant when the lever is pivotally displaced about a first axis, and a profile in a second direction whereby displacement of the lever about a second axis displaces the slider member so as to alter the biasing force.

28 Claims, 6 Drawing Sheets

JOYSTICK CONTROLLER

CROSS REFERENCE TO RELATED APPLICATION

This application relates to and claims priority to corresponding Great Britain Patent Application No. 0503663.7, which was filed on Feb. 23, 2005, and which is incorporated by reference herein.

TECHNICAL FIELD

The present invention relates to Joystick controllers.

BACKGROUND OF THE INVENTION

Joystick controllers are used in a wide variety of control applications. One example is in the control of an excavator bucket. Movement of the bucket is actuated by hydraulic pistons, which are controlled by electrical signals provided by the joystick. The joystick has a lever, which is mounted for pivotal movement relative to a fixed body. Movement of the lever in one direction, by pivoting the lever about a first axis, controls the raising and lowering of the bucket. Movement of the lever in a second direction, by pivoting about a second axis (usually orthogonal to the first axis), controls orientation of the bucket (i.e. moves the bucket by turning it to the left or the right).

When excavating earth it is frequently required to place the bucket controls into a so-called float configuration, in which the raising and lowering controls are over-ridden so that the bucket drops under its own weight to the ground. In the float configuration, the bucket stays at the ground and rests on the terrain. There is no hydraulic influence over its vertical position. However, it is still desirable that an operator of the excavator should be able to control the left-right orientation of the bucket using the joystick while leaving the bucket level free to move with terrain change. A float configuration can be achieved with a joystick that has a lock facility to prevent movement of the joystick lever in the direction that controls vertical movement of the bucket. When the joystick is locked, the vertical controls are overridden.

One such joystick controller has been described in GB 2,313,175. This joystick has a bush that can slide up and down a shaft of the lever and is biased by a spring against a cradle mounted on the joystick body. The cradle has a recess, which engages a shoulder of the bush when the joystick lever has been displaced by a certain angle about a first axis (say the x-axis), to hold the lever at that angle.

A problem with this arrangement is that, when in the locked position, pivotal movement of the joystick in the other direction about the orthogonal y-axis can only be achieved by a corresponding pivotal movement of the bush and cradle. This means that the cradle must be mounted to the joystick body in such a way that it is allowed to pivot about the y-axis. Furthermore, this joystick uses a gimbal arrangement by which the joystick lever is mounted to the body for pivotal movement. Nowadays it is often preferable to use a ball and socket arrangement for mounting the joystick lever.

Many known joystick controllers include a return-to-centre arrangement, so that when the lever is displaced and subsequently released it is biased back towards a central position. The degree of biasing force also provides a tactile feedback by which the operator can sense the extent of displacement. However, there are many applications where it may be required to keep the joystick at a displacement in one (e.g. x) direction. It is a problem to achieve this while still retaining the return-to-centre feature in the orthogonal y direction.

SUMMARY

It is an aim of the present invention to provide a joystick controller that alleviates the aforementioned problems.

According to a first aspect of the present invention there is provided a joystick controller having: a lever mounted for pivotal movement relative to a housing; a seat member affixed to the housing; and a slider member biased towards the seat member, wherein the seat member has a profiled surface that cooperates with a corresponding surface of the slider member, the profiled surface including at least one lock position for engaging the slider member at a predetermined angle of pivotal displacement of the lever about a first axis, and wherein the slider member is shaped to allow pivotal movement of the lever about a second axis, without movement of the slider member, but to prevent movement of the lever about the first axis when engaged in the lock position.

Preferably, the slider member has an opening through which the lever extends, the opening in the slider member being elongated to allow pivotal movement of the lever about the second axis. The second axis may be orthogonal to the first axis.

Preferably, the seat member and the housing are formed as a single integral component.

In embodiments of the invention, the lock position is at or close to a maximum extent of displacement of the lever. The lock position may be defined by a raised portion that engages in a corresponding recess in the corresponding surface of the slider member. Alternatively, the lock position may be defined by an outward facing lip or rim, the slider member having a corresponding inward facing lip that drops over the outward facing lip to lock the lever.

Embodiments may include a plurality of lock positions at different angular displacements of the lever about the first axis. An advantage of this arrangement is that it allows the joystick lever to be used for the dual function of left-right movement control (when moved about the second axis) and as a multi-position selector when moved about the first axis. In one embodiment the joystick has three lock positions providing a three-position selector, which may be used, for example, for defining forwards, neutral and reverse positions. Alternatively, the plurality of lock positions may be used as a gear selector for a multi-speed gearbox.

It will be appreciated that the biasing of the slider member ensures that the lever is always pressed against the seat member. When the slider member engages the seat member in the lock position the biasing action provides an additional force of engagement that holds the lever in the lock position. The lever may be taken out of the lock position by overcoming this additional engagement force to move the slider member out of engagement with the seat member.

The profiled surface of the seat member may have a profile that has a wave-like form. The wave-like form may approximate to a sine wave. The corresponding surface of the slider member may include at least a portion having a corresponding profile. It is an advantage that the wave-like form provides lock positions defined by the troughs of the waves.

Preferably, the wave-like form of the profiled surface of the seat member has a plurality of troughs defining a plurality of lock positions. It is a further advantage that the wave-like forms provide continuous smooth contacting surfaces between the slider member and the seat member so that movement of the lever out of a lock position, or from one lock position to another, can be done smoothly.

According to a second aspect of the present invention there is provided a joystick controller having: a lever mounted for pivotal movement relative to a housing; a seat member affixed to the housing; and a slider member biased by a biasing force towards the seat member, wherein the seat member has a profiled surface that cooperates with a corresponding surface of the slider member, the profiled surface having a profile in a first direction whereby the biasing force remains substantially constant when the lever is pivotally displaced about a first axis, and a profile in a second direction whereby displacement of the lever about a second axis displaces the slider member so as to alter the biasing force.

In a preferred embodiment the profiled surface of the seat member has a convex part-circular profile in the first direction. The cooperating surface of the slider member may have a corresponding concave part-circular profile in the first direction. The profile in the second direction may be uniform such that the entire profiled surface is part-cylindrical. Preferably, the seat member and the housing are formed as a single integral component.

In embodiments of this aspect of the invention, the substantially constant biasing force ensures that when the lever is pivotally displaced about the first axis, there is no change to this force so the lever will remain at the displaced angle until it is moved to a different angle. This aspect is known as "put and stay". When the lever is displaced about the second axis, the change to the biasing force may be used to provide a force that returns the lever to a central position.

Embodiments of this aspect may include a brake means for providing a frictional force to resist movement of the lever about the first axis. It is an advantage that the frictional force adds to the biasing force to help ensure that the joystick lever stays at the "put and stay" angle until moved to a different angle by the operator.

The brake means may comprise a spring and a pivoted lever for applying a brake force against a yoke member that is moved by displacement of the lever. Preferably, the lever carries a roller that bears against a cam surface of the yoke member to provide the frictional force. An advantage of this arrangement is that the frictional force is applied through the roller, but there is no sliding or rubbing of the surfaces when the joystick lever is moved to a different angle.

In embodiments of either aspect of the invention, the joystick controller further comprises an over-press feature, wherein an increase in biasing action of the slider member is provided when pivotal movement of the lever about the second axis is close to its maximum displacement. The over-press feature comprises a ramp profile on the slider member, or on the seat member.

BRIEF DESCRIPTION OF THE DRAWINGS

Embodiments of the invention will now be described with reference to the following drawings.

DETAILED DESCRIPTION OF THE PREFERRED EMBODIMENTS

Figure 1:
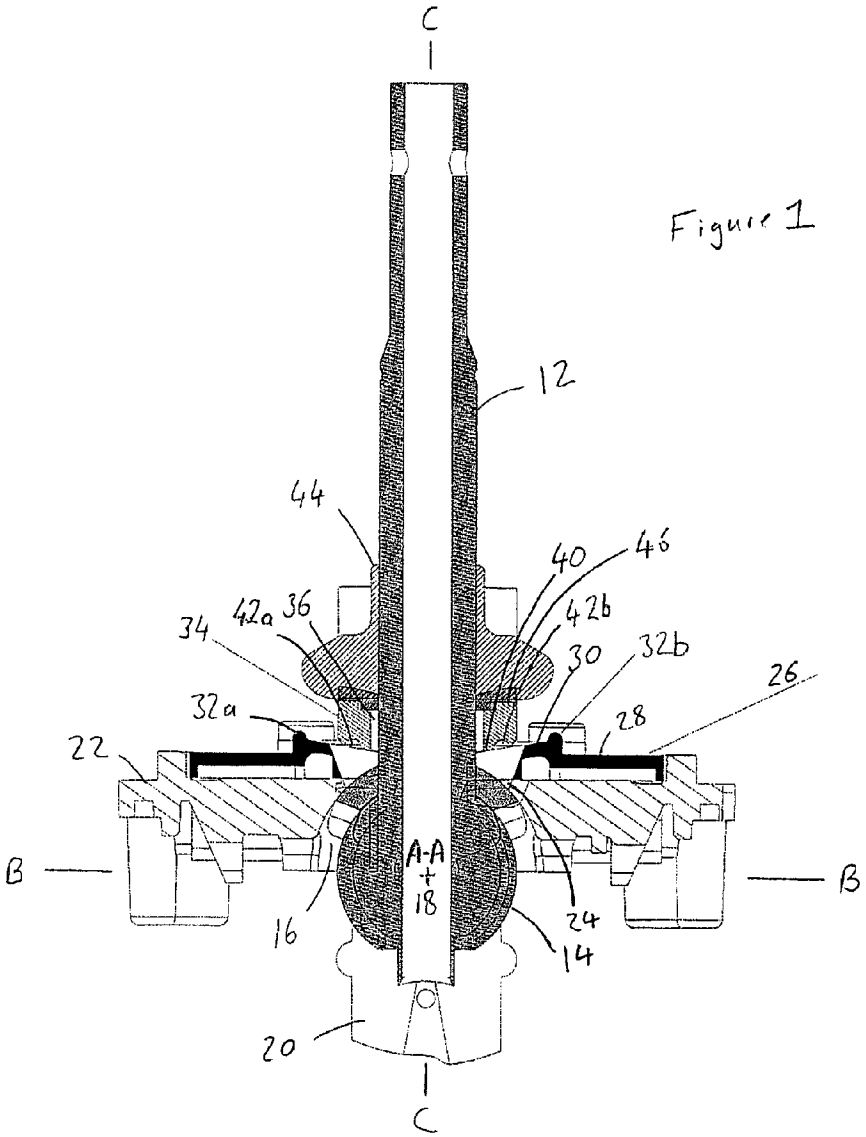
FIG. 1 is a cross-sectional elevation of parts of a joystick controller according to a first embodiment of the first aspect of the invention.

Referring to FIG. 1, a joystick controller 10 of the ball and socket type, has a lever 12 mounted to a ball 14, which is located in a part-spherical socket 16, allowing universal pivotal movement between the ball 14 and the socket 16 about a pivot centre 18. The pivot centre 18 is at the intersection of a first axis A—A, orthogonal to the plane of the page of FIG. 1, a second axis B—B, and a third axis C—C that defines an axis of the lever 12. The lever 12 extends past the pivot centre 18 to an armature 20. The armature 20 carries part of one or more movement detection devices (not shown) for providing output signals indicative of the pivotal movement of the lever 12. Examples of suitable movement detection devices include potentiometers or non-contact devices such as Hall effect sensors.

The socket 16 forms part of a housing, of which only a top portion 22 is shown in FIG. 1. The top portion 22 has a central opening 24 through which the lever 12 extends. The central opening 24 limits the maximum pivotal displacements of the lever 12 about the first axis A—A and the second axis B—B. A seat member 26 is mounted atop the top portion 22 of the housing. The seat member 26 has a profiled upper surface 28. In the embodiment shown in FIG. 1, the profiled surface 28 has a central portion 30 having a shallow angle, either side of which is a raised lip portion 32*a*, 32*b*.

A slider member 34 has a central opening 36 through which the lever 12 extends. The slider member 34 has a contact surface 38, which includes an inner portion 40 having a shallow angled profile of the same or similar angle to that of the central portion 30 of the profiled surface 28 of the seat member 26. Either side of the inner portion 40, the contact surface 38 includes a recess 42*a*, 42*b*. The recesses 42*a*, 42*b* are of a size to fit over and engage the corresponding raised lip portion 32*a*, 32*b* of the seat member 26.

A bush 44 is slideably mounted around the lever 12 and engages a top surface 46 of the slider member 34. The bush 44 is biased downwards against the top surface 46 by means of a compression spring (not shown). The compression spring is mounted around the lever 12 above the bush 44 and between the bush 44 and a stop (not shown) on the lever 12. The biasing action of the compression spring is transmitted through the bush to the slider member 34, so as to maintain a contacting force between the slider member 34 and the seat member 26.

Figure 2:
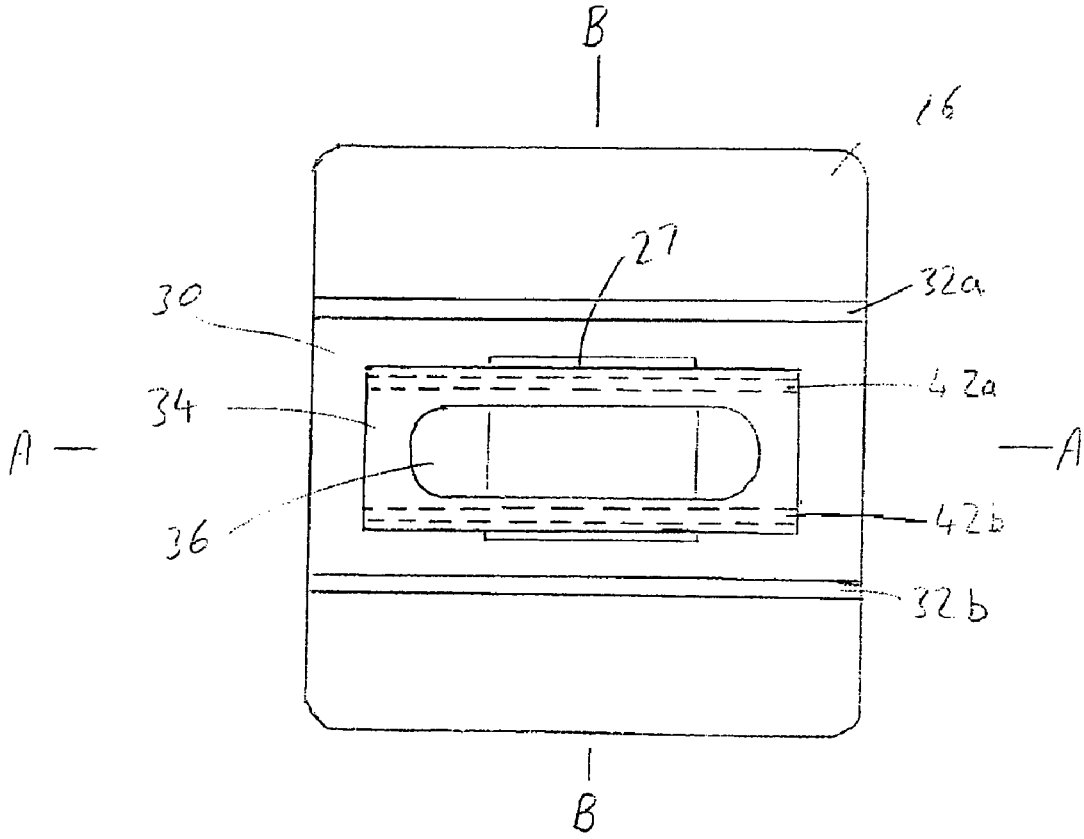
FIG. 2 is a plan view showing a slider member and seat member of the joystick of FIG. 1.

Referring to FIG. 2, in which corresponding features have the same reference numerals as used in FIG. 1, the seat member 26 has a central opening 27, through which the lever 12 (not shown) extends. The slider member 34 extends either side of the opening 27 such that there is always contact between surfaces of the slider member 34 and the seat member 26. The central opening 36 in the slider member 34 is elongated in the direction of the first axis A—A.

In use, when the lever 12 is close to its central, upright position, a small displacement of the lever 12 about the first axis A—A results in displacement of the slider member, causing sliding between the contacting angled surface 30 of the seat member 26, and the corresponding angled surface 40 of the slider member. This displacement urges the slider member 34 upwards, pushing the sliding bush 44 upwards against the biasing action of the spring. Further displacement of the lever about the first axis A—A in, say, a direction towards the top of the page of FIG. 2, causes further sliding movement, until the slider member 34 reaches the raised lip 32*a* on the seat member 26. Further displacement of the lever 12 causes the slider member 34 to lift up over the lip 32*a* until the recess 42*a* in the contacting surface of the slider member 34 engages onto the raised lip 32*a*. The biasing action of the spring causes increased resistance due to compression of the spring as the slider member is displaced upwards. This increased biasing action provides an increased force that serves to lock the slider member 34 onto the seat member 26.

At any stage, the lever 12 may be displaced in the orthogonal direction by pivoting about the second axis B—B without causing any movement of the slider member 34. The lever 12 is free to move in this direction due to the elongated shape of the opening 36 in the slider member 34. However, displacement of the lever in this second orthogonal direction causes the bush 44 to tilt with respect to the slider member 34 and in doing so the bush is displaced up the lever 12, compressing the spring. Thus movement of the lever in either direction causes compression of the spring, thereby retaining an important feature of the joystick, which is to return it to its central, or null position when it is released.

When used as a controller for an excavator bucket, the lever 12 controls the height of the bucket when it is pivoted about the first axis A—A, and controls the left-right angular position of the bucket when pivoted about the second axis B—B. However, if the lever 12 is pushed rapidly and firmly to the lock position where the recess 42*a* in the slider member engages with the lip 32*a*, the hydraulic system is configured to release hydraulic pressure so that the excavator bucket drops to the ground under its own weight. This places the excavator in the float configuration, in which the bucket stays at the ground and rests on the terrain. There is no hydraulic influence over its vertical position. However, an operator of the excavator can still use the joystick to control the left-right angular position of the bucket.

Figure 2A:
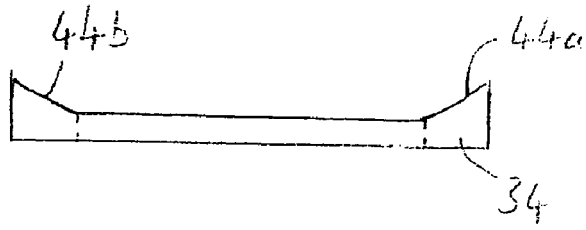
FIG. 2*a* is an elevational view of the slider member of FIG. 2.

Referring to FIG. 2*a*, the slider member 34 is shown in elevation and includes raised ramp portions 44*a*, 44*b* at each end. These ramps provide an over-press feature whereby, when pivotal movement of the lever about the second axis B—B is close to its maximum displacement in either direction, there is an increase in the biasing action of the bush 44 against the slider member 34. This provides a useful tactile feedback to the operator, to indicate that the joystick lever is nearing its limit of displacement.

Figure 3:
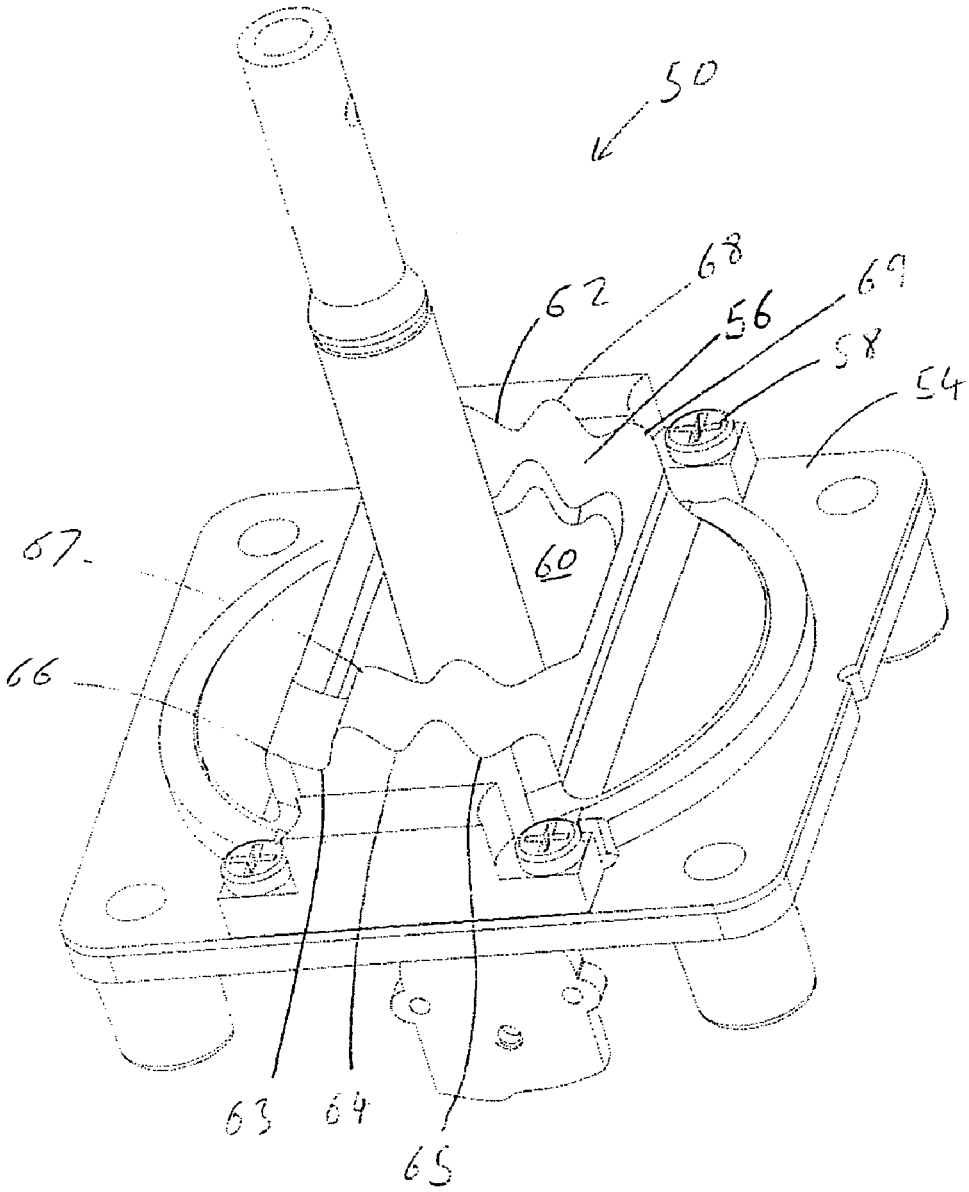
FIG. 3 is an isometric view of parts of a joystick controller according to a second embodiment of the first aspect of the invention.
Figure 4:
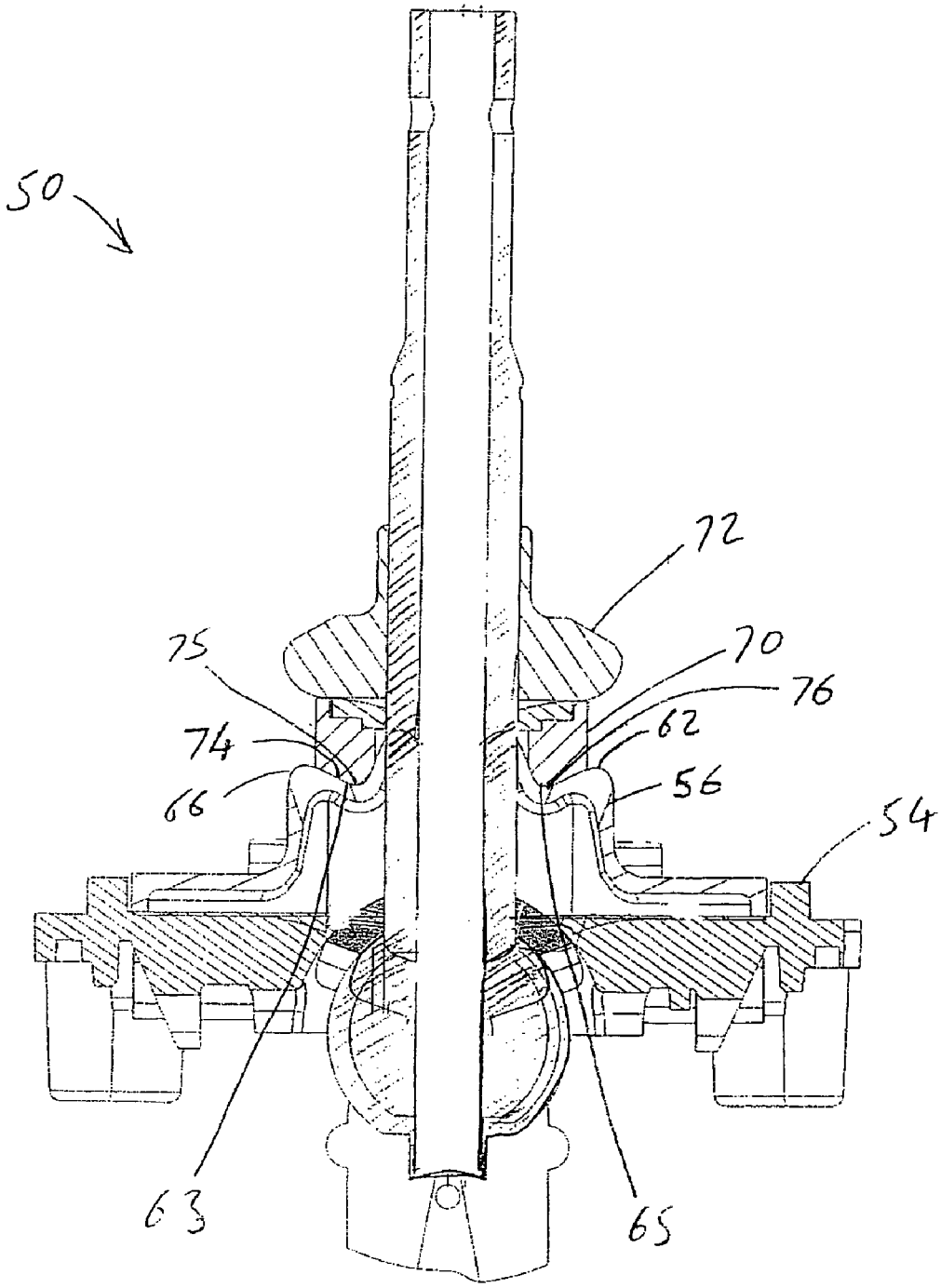
FIG. 4 is a sectional elevation of part of the joystick controller of FIG. 3.

FIGS. 3 and 4 show a joystick controller 50 having another form of profiled seat. FIG. 3 shows part of the joystick controller 50, including a lever 52 and a top portion 54 of a housing. A seat member 56 is fixed to the top portion 54 by way of fastener screws 58. The lever 52 extends through a central opening 60 in the seat member 56. The seat member 56 has a profiled upper surface 62, which has a waveform. In this case the waveform is based on a sine wave that has been shaped to follow a curved overall profile. The waveform includes three trough positions 63, 64, 65 and four wave peaks 66, 67, 68, 69.

Referring to FIG. 4, the joystick controller 50 includes a slider member 70, and a sliding bush 72, similar to those described above in relation to FIGS. 1 and 2. However, in this case the slider member has a contacting surface 74, which contacts the profiled surface 62 of the seat member 56 in two contact regions 75, 76 which are shaped to have a portion of a waveform that corresponds to the waveform of the profiled surface 62.

In this arrangement, the joystick 50 has three distinct lock positions with respect to its displacement about the first axis, as will be described in more detail below. As for the embodiment shown in FIGS. 1 and 2, displacement about the second axis is not affected.

The position of the joystick shown in FIG. 4 is the central position of the three. In this position, the contact regions 75, 76 of the slider member 70 contact the seat member at the two outer trough positions 63, 65 of the profiled surface. Displacement of the lever in one direction (for example to the left as shown in FIG. 4) by pivoting about the first axis will cause the contact regions 75, 76 of the slider member 70 to ride up the sides of the troughs 63, 65 of the profiled surface 62 and over two of the peaks. The contact 75 slides over the outer peak 66 and then drops down to rest beyond the peak 66. The contact region 76 slides over an inner peak 68 (see FIG. 3) and then drops down to rest in the central trough 64 (see FIG. 3). It will be appreciated that the biasing action of the spring causes the lever to be held in the lock position. However, the waveform profile means that the lever can be moved from one lock position to another in a smooth sliding movement between the correspondingly profiled surfaces.

The three lock positions of the joystick 50, allow it to be used as both a positional controller (when moved forwards or backwards in the orientation depicted in FIGS. 3 and 4), and a selector when moved into one of the three lock positions. For example, the three lock positions may correspond to forward, neutral and reverse positions for selecting a direction of movement (or to up, neutral and down, for raising or lowering applications). Clearly, the number of lock positions need not be limited to three. A greater (or smaller) number of lock positions could be provided for selection, for example, of gears in a multi-speed gearbox.

Referring now to FIGS. 5*a* to 5*e*, a joystick controller 100 has a lever 102 mounted for pivotal movement relative to a body 104, by means of a ball and socket arrangement 106. A first yoke 108 is pivotally mounted on a first axis X—X. A second yoke 110 is pivotally mounted on a second axis Y—Y, orthogonal to the first axis X—X. The first axis X—X and the second axis Y—Y cross at the pivot centre 111 of the ball and socket arrangement 106.

Figure 5C:
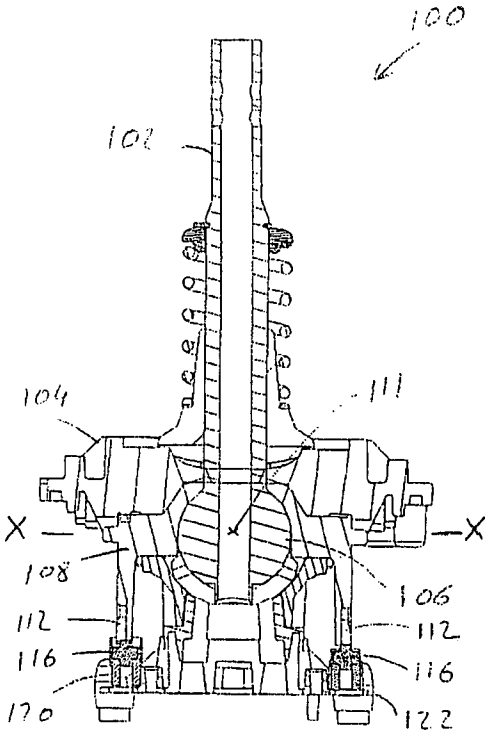
FIG. 5*c* is a sectional elevation of the joystick controller of FIGS. 5*a* and 5*b* in an orthogonal plane.
Figure 5B:
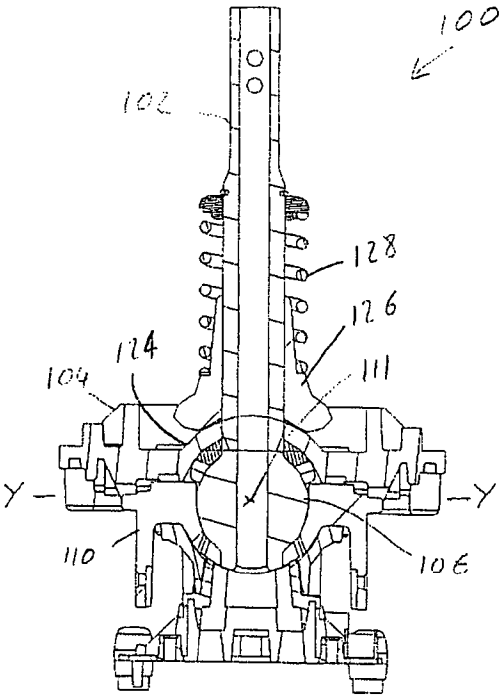
FIG. 5*b* is a sectional elevation of the joystick controller of FIG. 5*a*.
Figure 5A:
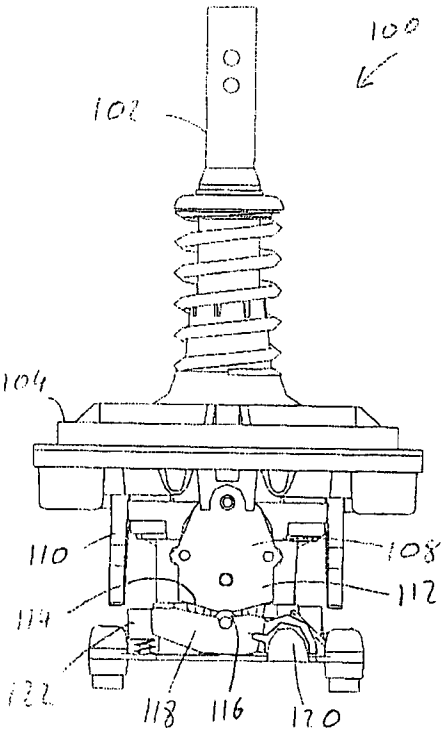
FIG. 5*a* is an elevation of a joystick controller according to an embodiment of the second aspect of the invention.

As shown in FIG. 5*a*, and in cross-section in FIG. 5*c*, the first yoke 108 has a pair of armatures 112 extending downwards from the first axis X—X. The lower end of each armature 112 defines a cam surface 114, which abuts a roller 116 carried in a centrally aligned position by a lever arm 118. Each lever arm 118 is supported at one end on a pivot mounting 120, and at the other on a spring mounting 122. The spring mounting 122 biases the lever arm 118 upwards so that the roller 116 is biased into abutment with the cam surface 114.

As shown in FIG. 5*b*, the body 104 has a top surface that forms a seat 124. The seat 124 has a convex cross-section profile that includes part of a circle centred on the pivot centre 111 of the ball and socket 106. A slider member 126 of generally conical shape has a bore through which the lever 102 extends. A spring 128 biases the slider member down the lever 102 into contact with the seat 124. The surface of the slider member 126, which is in contact with the seat 124 has a corresponding concave profile. In FIGS. 5*a* and 5*b* the lever 102 is in its central position and so the biasing action of the spring is symmetrical around the lever 102.

The seat 124 extends uniformly parallel to the first axis X—X such that the entire profiled surface is part-cylindrical. This means that when the lever 102 is displaced so as to pivot about the second axis Y—Y, one side is urged against the seat 124, while the opposing side lifts clear of the seat 124. The slider member 126 is urged to slide up the lever 102 so as to compress the spring 128. At the same time the biasing force against the lever 102 is no longer symmetrical, and so creates a moment that acts to return the lever to its central position.

Figure 5E:
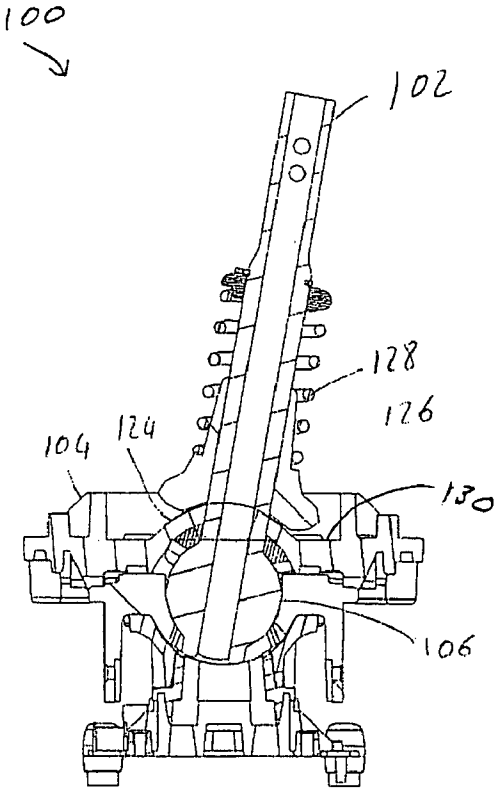
FIG. 5*e* is a sectional elevation of the joystick controller of FIG. 5*d*.
Figure 5D:
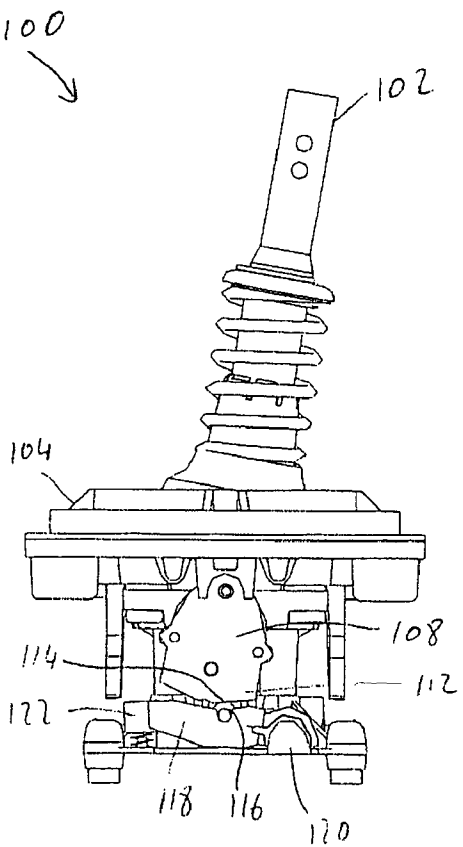
FIG. 5*d* is an elevation of the joystick controller of FIGS. 5*a* to 5*c*, in which the joystick lever is pivotally displaced.

On the other hand, as shown in FIGS. 5*d* and 5*e*, when the lever 102 is displaced so as to pivot about the first axis X—X, the profile of the seat 124 means that there is no corresponding urging of the slider member 126 against the seat. The slider member 126 is not urged to slide up the lever, and there is no change to the biasing action of the spring 128 and no moment created on the lever 102. Consequently, the lever 102 will remain in the displaced position (angle) until moved to a new position.

Moreover, the cam surface 114 on the armature 112 is moved (as shown in FIG. 5*d*) and this acts against the roller 116 pushing down on the lever arm 118, which pivots on the pivot mounting 120 and compresses the spring mounting 122. This increases the reaction force between the roller 116 and the cam surface 114 and increases the frictional resistance to further movement, thereby creating a brake effect. As a consequence the lever 102 will remain in the displaced position until such time as the operator moves it by overcoming the increased frictional force. This produces the aforementioned "put and stay" capability. Note that, although providing a frictional brake effect, there is no sliding or rubbing of mating surfaces, thereby avoiding frictional wearing of the surfaces.

It will be appreciated that it is possible to vary the profile of the seat 124 in the direction parallel to the first axis X—X, so as to vary the amount displacement of the slider member (and in consequence the size of the biasing force). In one embodiment, the seat 124 has a part spherical profile so that the "put-and-stay" facility applies when the lever 102 is displaced in any direction. In this embodiment additional brake arrangements may be included for applying an increased reaction force to the second yoke 110. The additional brake arrangements may include a further pair of pivotal and spring mounted levers carrying rollers that bear against cam surfaces on armatures of the second yoke 110.

As can be seen in FIG. 5*e*, further pivotal displacement of the joystick lever 102 will cause the conical slider member 126 to come into contact with an outer flat portion 130 beyond the convex seat 124. The conical slider member 126 will be urged up the shaft of the lever 102 to compress the spring 128. This results in an eccentric reaction force on the lever, tending to urge it back towards its central position, and provides an over-press feature, similar to that described above for the joystick of FIGS. 1 to 2*a*, to present a tactile feedback to the operator indicating that the joystick lever is nearing its limit of displacement.

The invention claimed is:

1. A joystick controller having: a lever mounted for pivotal movement relative to a housing; a seat member affixed to the housing; and a slider member biased towards the seat member, wherein the seat member has a profiled surface that cooperates with a corresponding surface of the slider member, the profiled surface including at least one lock position for engaging the slider member at a predetermined angle of pivotal displacement of the lever about a first axis, and wherein the slider member is shaped to allow pivotal movement of the lever about a second axis, without movement of the slider member, but to prevent movement of the lever about the first axis when engaged in the lock position.

2. The joystick controller of claim 1, wherein the slider member has an opening through which the lever extends, the opening in the slider member being elongated to allow pivotal movement of the lever about the second axis.

3. The joystick controller of claim 2, wherein the second axis is orthogonal to the first axis.

4. The joystick controller of claim 1, wherein the seat member and the housing are formed as a single integral component.

5. The joystick controller of claim 1, wherein the lock position is at or close to a maximum extent of displacement of the lever.

6. The joystick controller of claim 1, wherein the lock position is defined by a raised portion that engages in a corresponding recess in the corresponding surface of the slider member.

7. The joystick controller of claim 1, wherein the lock position is defined by an outward facing lip or rim, the slider member having a corresponding inward facing lip that drops over the outward facing lip to lock the lever.

8. The joystick controller of claim 1, including a plurality of lock positions at different angular displacements of the lever about the first axis.

9. The joystick controller of claim 8, wherein the joystick has three lock positions providing a three-position selector, which may be used, for example, for defining forwards, neutral and reverse positions.

10. The joystick controller of claim 8, wherein the plurality of lock positions are used as a gear selector for a multi-speed gearbox.

11. The joystick controller of claim 1, wherein the lever is configured be taken out of the lock position by overcoming the biasing to move the slider member out of engagement with the seat member.

12. The joystick controller of claim 1, wherein the profiled surface of the seat member has a wave-like form.

13. The joystick controller of claim 12, wherein the wave-like form approximates to a sine wave.

14. The joystick controller of claim 12, wherein the corresponding surface of the slider member includes at least a portion having a corresponding profile.

15. The joystick controller of claim 12, wherein the wave-like form of the profiled surface of the seat member has a plurality of troughs defining a plurality of lock positions.

16. The joystick controller of claim 1, further comprising an over-press feature, wherein an increase in biasing action of the slider member is provided when pivotal movement of the lever about the second axis is close to its maximum displacement.

17. The joystick controller of claim 16, wherein the over-press feature comprises a ramp profile on the slider member or on the seat member.

18. The joystick controller of claim 16, wherein the over-press feature comprises a ramp profile on the slider member or on the seat member.

19. A joystick controller having: a lever mounted for pivotal movement relative to a housing; a seat member affixed to the housing; and a slider member biased by a biasing force towards the seat member, wherein the seat member has a profiled surface that cooperates with a corresponding surface of the slider member, the profiled surface having a profile in a first direction whereby the biasing force remains substantially constant when the lever is pivotally displaced about a first axis, and a profile in a second direction whereby displacement of the lever about a second axis displaces the slider member so as to alter the biasing force.

20. The joystick controller of claim 19, wherein the profiled surface of the seat member has a convex part-circular profile in the first direction.

21. The joystick controller of claim 20, wherein the cooperating surface of the slider member has a corresponding concave part-circular profile in the first direction.

22. The joystick controller of claim 20, wherein the profile in the second direction is uniform such that the entire profiled surface is part-cylindrical.

23. The joystick controller of claim 19, wherein the seat member and the housing are formed as a single integral component.

24. The joystick controller of claim 19, configured such that when the lever is displaced about the second axis, a change to the biasing force provides a force that returns the lever to a central position.

25. The joystick controller of claim 19, including brake means for providing a frictional force to resist movement of the lever about the first axis.

26. The joystick controller of claim 25, wherein the brake means comprises a spring and a pivoted lever for applying a brake force against a yoke member that is moved by displacement of the lever.

27. The joystick controller of claim 26, wherein the lever carries a roller that bears against a cam surface of the yoke member to provide the frictional force.

28. The joystick controller of claim 19, further comprising an over-press feature, wherein an increase in biasing action of the slider member is provided when pivotal movement of the lever about the second axis is close to its maximum displacement.

* * * * *